US005501431A

United States Patent [19]

Pfister et al.

[11] Patent Number: 5,501,431

[45] Date of Patent: Mar. 26, 1996

[54] MELTING FURNACE FOR RESIDUES FROM WASTE INCINERATION PLANTS

[75] Inventors: Markus Pfister, Döttingen; Christian Wieckert, Seon, both of Switzerland

[73] Assignee: ABB K.K., Tokyo, Japan

[21] Appl. No.: 449,843

[22] Filed: May 24, 1995

[30] Foreign Application Priority Data

May 28, 1994 [DE] Germany ..... 44 18 734.3

[51] Int. Cl.[6] ..... C21B 7/04

[52] U.S. Cl. ..... 266/242; 266/280; 266/286

[58] Field of Search ..... 266/242, 275, 266/280, 286; 432/248

[56] References Cited

U.S. PATENT DOCUMENTS

| | | | |
|---|---|---|---|
| 2,704,419 | 3/1955 | Hewitt et al. | 266/286 |
| 3,148,238 | 9/1964 | Willenbrock, Jr. | 266/280 |
| 3,258,257 | 6/1966 | Wilson et al. | 266/286 |
| 3,764,125 | 10/1973 | Horn et al. | 266/280 |

FOREIGN PATENT DOCUMENTS

| | | | |
|---|---|---|---|
| 2153011 | 6/1990 | Japan | 266/280 |
| 404167963 | 6/1992 | Japan | 266/280 |

*Primary Examiner*—Scott Kastler
*Attorney, Agent, or Firm*—Oblon, Spivak, McClelland, Maier & Neustadt

[57] ABSTRACT

A melting furnace for melting residues from refuse incineration plants, in particular filter dust melting furnaces, contains a furnace substructure and a furnace superstructure lined with different refractive material compositions. The lining in the substructure, the melting region, is a refractory material which, in addition to other metal oxides, contains 10–70% wt. % $Cr_2O_3$. The lining in the superstructure, the gas atmosphere region, is a refractory material which contains 80 wt. % or more of MgO and is low in $Cr_2O_3$ or is virtually $Cr_2O_3$-free. A furnace constructed in this manner exhibits long endurance and does not form toxic chromium compounds in the chromium-free gas region.

9 Claims, 1 Drawing Sheet

MELTING FURNACE FOR RESIDUES FROM WASTE INCINERATION PLANTS

BACKGROUND OF THE INVENTION

1. Field of the invention

The invention relates to a melting furnace for residues from refuse incineration plants, in particular a filter dust melting furnace which includes a furnace vessel comprising substructure and superstructure, which furnace vessel is lined internally with a lining of refractory material.

2. Discussion of Background

A melting furnace of this generic type is described in the company publication "Die thermische Reststoffbehandlung nach dem DEGLOR-Verfahren" (Thermal treatment of residues by the DEGLOR process") from ABB W+E Umwelttechnik, CH-8048 Zurich, undated.

In the DEGLOR process (DEGLOR is a registered mark of the company W+E Umwelttechnik AG, CH-8048 Zurich), filter dust and boiler ash are treated in an electrically heated melting furnace at temperatures around 1300° C. The residues melt and are discharged from the furnace via a gas tight syphon and then cooled. A vitreous residue which may be landfilled without problem is formed in the course of this process. During the melting process, most of the heavy metal compounds volatilize. Organic pollutants such as dioxins or furans are thermally destroyed. Non-volatilizing high-boiling metal compounds are incorporated into the glass matrix in a similar manner to lead, in lead crystal glass. A fan downstream of the furnace ensures that the volatilized components are removed from the furnace by suction.

Both the (glass) melt and the gas atmosphere in these furnaces are substantially more corrosive than in conventional glass furnaces. The choice of material for the lining of these furnaces is, therefore, of decisive importance for the service life and thus for economical use of this process.

SUMMARY OF THE INVENTION

Accordingly, one object of the invention is to provide a novel lining for such melting furnaces which exhibits a long lifetime.

This and other objects which will become apparent from the course of the following description of exemplary embodiments have been achieved by a melting furnace having a furnace vessel, where the furnace vessel has a substructure portion for contacting and holding the melt (molten glass) and a superstructure portion in contact with the gas atmosphere above the melt. It has been discovered that improved service life of the furnace vessel can be achieved by lining the substructure portion of the furnace vessel with a first refractory material and lining the superstructure portion of the furnace vessel with a second different refractory material. The use of two different refractory materials provides improved service life and reduced toxicity of furnace products.

The refractory material used to line the substructure portion, which is in contact with the melt, should contain about 10–70% by weight chromium oxide ($Cr_2O_3$). The refractory material used to line the superstructure portion should contain 80 wt. % or more magnesium oxide (MgO) and little or no chromium oxide.

A melting furnace having such a different lining composition in the melting region and the furnace superstructure produces surprisingly long lifetimes. It is essential in this case that the lining in the furnace superstructure, that is in the gas atmosphere, contains no $Cr_2O_3$ or as little $Cr_2O_3$ as possible, since chromium can form toxic compounds with substances in the gas atmosphere.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
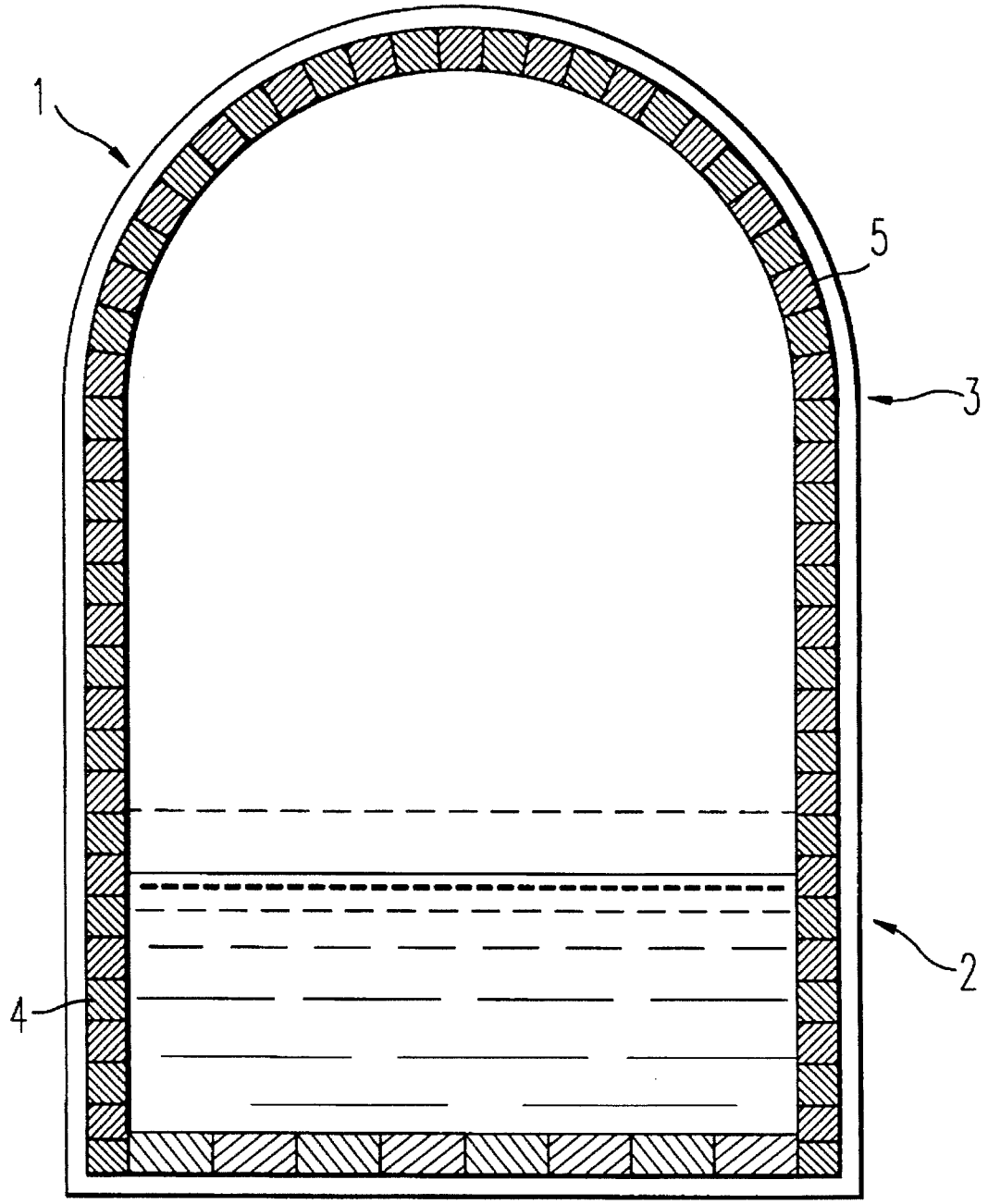
FIG. 1 is a cross-section through a glass melting furnace of the invention having different linings in the substructure and superstructure of the furnace.

Referring now to the drawing, in FIG. 1 the melting furnace for filter dust includes a furnace vessel 1, having furnace substructure 2 (melting region) and furnace superstructure 3 (gas region). Both furnace areas are lined internally with refractory material 4 and 5, respectively. The lining itself generally comprises bricks laid to be close fitting which are joined together using a refractory mortar appropriate to the refractory material Refractory mortar and use thereof are well-known in the art.

The refractory material used in the melting region of the substructure portion generally contains 10–70 wt. %, preferably 20–50 wt. % $Cr_2O_3$, 10–60 wt. %, preferably 12–56 wt. % $Al_2O_3$ and 5–15 wt. %, preferably 7–11 wt, % $ZrO_2$. The refractory material in the melting region may also contain 0.01–1 wt. %, preferably 0.1–0.5 wt % $Fe_2O_3$ and 1–10 wt. %, preferably 2–8 wt. % $SiO_2$. When the refractory material in the melting region contains $Cr_2O_3$, $Al_2O_3$ and $ZrO_2$, the material preferably contains 20–50 wt. % $Cr_2O_3$. The refractory material may contain small amounts of inevitable impurities.

In a further embodiment, the refractory material in the melting region may contain MgO. In this embodiment the refractory material lining in the melting region contains 90–60 wt. % MgO and 10–40 wt. % $Cr_2O_3$.

The refractory material contacting the gas atmosphere in the furnace superstructure portion, i.e. refractory lining bricks 5 in superstructure 3 shown in FIG. 1, preferably contain 80 wt. % or more MgO, more preferably at least 90 wt. % MgO and 20–0 wt. %, preferably 10–1 wt. % $Al_2O_3$, $ZrO_2$ or mixtures thereof. It is important that the refractory material lining the superstructure portion of the furnace be substantially free of $Cr_2O_3$. By "substantially free" is meant that the refractory material contains less than 1 wt. % $Cr_2O_3$. Most preferably, the refractory material lining the superstructure portion contains 100% MgO, but may contain small amounts of inevitable impurities.

Refractory material, in the form of bricks, having the composition required for each of the superstructure portion and substructure portion of the melting furnace are available commercially. Suitable refractory bricks available from Didier Werke, Germany are shown in Table 1 below. The melting furnace of the present invention can be lined with these bricks to complete the invention.

TABLE 1

| | Refractory Bricks | | | | | |
|---|---|---|---|---|---|---|
| | $Al_2O_3$ | $SiO_2$ | MgO | $Fe_2O_3$ | $Cr_2O_3$ | $ZrO_2$ |
| SUPRAL ARZ 20 | 12 | 6 | — | 0.3 | 66 | 11 |
| SUPRAL ARZ 60 | 56 | 3 | — | 0.2 | 31 | 7.5 |
| RUBINAL BS | 0.1 | 0.1 | 99 | 0.1 | — | — |
| RUBINAL EN | 0.2 | 3.8 | 94 | 0.2 | — | — |
| RUBINAL MTG | 0.2 | 3.6 | 91.5 | 3 | — | — |
| RUBINAL VS | 0.1 | 1.0 | 96.5 | 0.3 | — | — |

Obviously numerous modifications and variations of the present invention are possible in light of the above teachings. It is, therefore, to be understood that within the scope of the appended claims, the invention may be practiced otherwise than as specifically described therein.

What is claimed as new and desired to be secured by Letters Patent of the United States is:

1. A melting furnace, comprising:

a furnace vessel having a substructure portion for contacting and holding a melt and a superstructure portion in contact with a gas atmosphere above said melt, wherein said substructure portion is lined internally with a refractory material comprising 10–70 wt. % $Cr_2O_3$, 10–60 wt. % $Al_2O_3$ and 5–14 wt. % $ZrO_2$, and said superstructure portion is lined with a refractory material comprising 80–100 wt. % MgO and 20–0 wt. % $Al_2O_3$, $ZrO_2$ or mixture thereof.

2. The furnace of claim 1, wherein said substructure portion is lined with a refractory material comprising 20–50 wt. % $Cr_2O_3$.

3. The furnace of claim 1, wherein said substructure portion is lined with a refractory material comprising 12–56 wt. % $Al_2O_3$.

4. The furnace of claim 1, wherein said substructure portion is lined with a refractory material comprising 7–11 wt. % $ZrO_2$.

5. The furnace of claim 1, wherein said substructure portion is lined with a refractory material further comprising 0.01–1 wt. % $Fe_2O_3$, 1–10 wt. % $SiO_2$ or a mixture thereof.

6. The furnace of claim 5, wherein said substructure portion is lined with a refractory material comprising 0.1–0.5 wt. % $Fe_2O_3$, 2–8 wt. % $SiO_2$ or a mixture thereof.

7. The furnace of claim 1, wherein said superstructure portion is lined with a refractory material comprising 90–100 wt. % MgO and 10–1 wt. % $Al_2O_3$, $ZrO_2$ or a mixture thereof.

8. The furnace of claim 1, wherein said superstructure portion is lined with a refractory material comprising 100 wt. % MgO.

9. A melting furnace, comprising:

a furnace vessel having a substructure portion for contacting and holding a melt and a superstructure portion in contact with a gas atmosphere above said melt, wherein said substructure portion is lined internally with a refractory material comprising 90–60 wt. % MgO and 10–40 wt. % $Cr_2O_3$, and said superstructure portion is lined with a refractory material comprising 80–100 wt. % MgO and 20–0 wt. % $Al_2O_3$, $ZrO_2$ or a mixture thereof.

* * * * *